US010233593B2

(12) United States Patent
Manifold et al.

(10) Patent No.: US 10,233,593 B2
(45) **Date of Patent: *Mar. 19, 2019**

(54) UNITARY DEFLECTION MEMBER FOR MAKING FIBROUS STRUCTURES AND PROCESS FOR MAKING SAME

(71) Applicant: The Procter & Gamble Company, Cincinnati, OH (US)

(72) Inventors: John Allen Manifold, Sunman, IN (US); John Leslie Brent, Jr., Springboro, OH (US); James Michael Singer, Liberty Township, OH (US); Gustav Andres Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 61 days.

This patent is subject to a terminal disclaimer.

(21) Appl. No.: 15/462,950

(22) Filed: Mar. 20, 2017

(65) Prior Publication Data

US 2017/0275822 A1 Sep. 28, 2017

Related U.S. Application Data

(60) Provisional application No. 62/312,539, filed on Mar. 24, 2016.

(51) Int. Cl.
*D21F 1/00* (2006.01)
*D21F 11/00* (2006.01)

(52) U.S. Cl.
CPC ..... *D21F 1/009* (2013.01); *D21F 11/006* (2013.01)

(58) Field of Classification Search
USPC ..... 162/361
See application file for complete search history.

(56) References Cited

U.S. PATENT DOCUMENTS

| | | | |
|---|---|---|---|
| 5,893,965 | A | 4/1999 | Trokhan et al. |
| 5,948,210 | A | 9/1999 | Huston |
| 6,420,100 | B1 | 7/2002 | Trokhan et al. |
| 6,660,362 | B1 | 9/2003 | Lindsay et al. |
| 7,005,043 | B2 | 2/2006 | Toney et al. |
| 7,014,735 | B2 | 3/2006 | Kramer et al. |
| 7,005,044 | B2 | 4/2006 | Kramer et al. |

(Continued)

FOREIGN PATENT DOCUMENTS

| | | |
|---|---|---|
| EP | 2123826 A2 | 5/2009 |
| WO | WO 2003/82550 A2 | 10/2003 |

(Continued)

OTHER PUBLICATIONS

U.S. Appl. No. 15/180,211, filed Jun. 13, 2016, Manifold, et al.

(Continued)

*Primary Examiner* — Mark Halpern
(74) *Attorney, Agent, or Firm* — Andrew J. Mueller

(57) ABSTRACT

A deflection member. The deflection member can be a unitary structure having a plurality of discrete primary elements and a plurality of secondary elements. At least one of the secondary elements can be an elongate member having a major axis having both a machine direction vector component and a cross machine direction vector component. In an example, the secondary elements can be arranged in a Voronoi pattern.

20 Claims, 8 Drawing Sheets

(56) References Cited

U.S. PATENT DOCUMENTS

| | | | |
|---|---|---|---|
| 7,105,465 | B2 | 9/2006 | Patel et al. |
| 7,799,382 | B2 | 9/2010 | Payne et al. |
| 8,216,427 | B2 | 7/2012 | Klerelid et al. |
| 8,454,800 | B2 | 6/2013 | Mourad et al. |
| 8,470,133 | B2 | 6/2013 | Cunnane et al. |
| 8,758,569 | B2 | 6/2014 | Aberg et al. |
| 8,801,903 | B2 | 8/2014 | Mourad et al. |
| 8,815,057 | B2 | 8/2014 | Eberhardt et al. |
| 8,822,009 | B2 | 9/2014 | Riviere et al. |
| 9,005,710 | B2 | 4/2015 | Jones et al. |
| 2005/0123726 | A1 | 6/2005 | Broering et al. |
| 2005/0280184 | A1 | 12/2005 | Sayers et al. |
| 2006/0019567 | A1 | 1/2006 | Sayers |
| 2006/0127641 | A1 | 6/2006 | Barnholtz et al. |
| 2006/0278298 | A1 | 12/2006 | Ampulski et al. |
| 2007/0137814 | A1 | 6/2007 | Gao |
| 2007/0170610 | A1 | 7/2007 | Payne et al. |
| 2008/0199655 | A1 | 8/2008 | Monnerie et al. |
| 2008/0245498 | A1 | 10/2008 | Ostendorf et al. |
| 2010/0119779 | A1 | 5/2010 | Ostendorf et al. |
| 2011/0265967 | A1 | 11/2011 | Phan |
| 2012/0043036 | A1 | 2/2012 | Polat et al. |
| 2014/0004307 | A1 | 1/2014 | Sheehan |
| 2014/0272269 | A1 | 9/2014 | Hensen |
| 2015/0102526 | A1 | 4/2015 | Ward et al. |
| 2016/0060811 | A1 | 3/2016 | Riding et al. |
| 2016/0090692 | A1 | 3/2016 | Eagles et al. |
| 2016/0090693 | A1 | 3/2016 | Eagles et al. |
| 2016/0159007 | A1 | 6/2016 | Miller et al. |
| 2016/0185041 | A1 | 6/2016 | Lisagor et al. |
| 2016/0185050 | A1 | 6/2016 | Topolkaraev et al. |
| 2017/0275821 | A1* | 9/2017 | Manifold ..... D21F 1/009 |

FOREIGN PATENT DOCUMENTS

| | | | |
|---|---|---|---|
| WO | WO 2004/45834 | A1 | 6/2004 |
| WO | WO 2015/00755 | A1 | 1/2015 |
| WO | WO 2016/085704 | A1 | 6/2016 |

OTHER PUBLICATIONS

U.S. Appl. No. 15/132,291, filed Apr. 19, 2016, Manifold, et al.
U.S. Appl. No. 15/132,293, filed Apr. 19, 2016, Manifold, et al.
U.S. Appl. No. 15/132,295, filed Apr. 19, 2016, Manifold, et al.
U.S. Appl. No. 15/462,949, filed Mar. 20, 2017, Manifold, et al.
PCT International Search Report dated Aug. 19, 2016—pages.
PCT International Search Report dated Jul. 12, 2016—4 pages.
PCT International Search Report dated Aug. 9, 2016—4 pages.
PCT International Search Report dated May 29, 2017—4 pages.
All Office Actions U.S. Appl. No. 15/180,211.
All Office Actions U.S. Appl. No. 15/132,291.
All Office Actions U.S. Appl. No. 15/132,293.
All Office Actions U.S. Appl. No. 15/132,295.
All Office Actions U.S. Appl. No. 15/462,949.
All Office Actions U.S. Appl. No. 15/462,950.

* cited by examiner

UNITARY DEFLECTION MEMBER FOR MAKING FIBROUS STRUCTURES AND PROCESS FOR MAKING SAME

FIELD OF THE INVENTION

The present disclosure is related to deflection members for making absorbent fibrous webs, such as, for example, paper webs. More particularly, this invention is concerned with structured fibrous webs, equipment used to make such structured fibrous webs, and processes therefor.

BACKGROUND OF THE INVENTION

Products made from a fibrous web are used for a variety of purposes. For example, paper towels, facial tissues, toilet tissues, napkins, and the like are in constant use in modern industrialized societies. The large demand for such paper products has created a demand for improved versions of the products. If the paper products such as paper towels, facial tissues, napkins, toilet tissues, mop heads, and the like are to perform their intended tasks and to find wide acceptance, they must possess certain physical characteristics.

Among the more important of these characteristics are strength, softness, absorbency, and cleaning ability. Strength is the ability of a paper web to retain its physical integrity during use. Softness is the pleasing tactile sensation consumers perceive when they use the paper for its intended purposes. Absorbency is the characteristic of the paper that allows the paper to take up and retain fluids, particularly water and aqueous solutions and suspensions. Important not only is the absolute quantity of fluid a given amount of paper will hold, but also the rate at which the paper will absorb the fluid. Cleaning ability refers to a fibrous structures' capacity to remove and/or retain soil, dirt, or body fluids from a surface, such as a kitchen counter, or body part, such as the face or hands of a user.

Through-air drying papermaking belts comprising a reinforcing element and a resinous framework, and/or fibrous webs made using these belts are known. The resinous framework may be continuous or semi-continuous. The resinous framework extends outwardly from the reinforcing element to form a web-side of the belt (i. e., the surface upon which the web is disposed during a papermaking process), a backside opposite to the web-side, and deflection conduits extending therebetween. Sometimes called deflection members, the reinforcing element is always a woven (or felt) substrate in which woven filaments are oriented in either the machine direction (MD) or cross machine direction (CD) in a relatively closely spaced woven pattern.

An improvement on deflection members is disclosed in commonly owned U.S. Provisional Application 62/155,517, entitled Unitary Deflection Member for Making Fibrous Structures Having Increased Surface Area and Process for Making Same, filed by Manifold et al. on May 1, 2015. The reinforcing member of Manifold et al. can mimic a woven substrate in which filaments are oriented in either the machine direction (MD) or cross machine direction (CD) in a relatively closely spaced woven pattern.

However, there remains an unmet need for a papermaking surface, including the type described as deflection members, having a three-dimensional topography that permits greater degrees of freedom with respect to open area, air permeability, strength, and paper structures.

Additionally, there is an unmet need for a method for making a papermaking surface, including the type described as deflection members, having a three-dimensional topography that permits greater degrees of freedom with respect to open area, air permeability, strength, and paper structures.

SUMMARY OF THE INVENTION

A deflection member is disclosed. The deflection member can be a unitary structure having a plurality of discrete primary elements and a plurality of secondary elements. At least one of the secondary elements can be an elongate member having a major axis having both a machine direction vector component and a cross machine direction vector component. In an example, the secondary elements can be arranged in a Voronoi pattern.

DETAILED DESCRIPTION OF THE INVENTION

Unitary Deflection Member

The deflection member of the present invention can be a unitary structure manufactured by additive manufacturing processes, including what is commonly described as "3-D printing." As such, the unitary deflection member is not achieved by the use of a mask and UV-curable resin, in which a resin and a reinforcing member are provided as separate parts and joined as separate components in a non-unitary manner.

The deflection member of the present invention includes discrete primary elements connected by secondary elements in a unitary structure which does not necessarily have a portion resembling a woven structure of interwoven MD and CD elements. The term "deflection member" as used herein refers to a structure useful for making fibrous webs such as absorbent paper products, but which has protuberances that define deflection conduits not formed by any underlying woven or grid-like structure. Woven papermaking fabrics or papermaking fabrics based on a structure of woven filaments are not deflection members as used in the instant disclosure.

By "unitary" as used herein is meant that the deflection member does not constitute a unit comprised of previously separate components joined together. Unitary can mean that all the portions described herein are formed as a single unit, and not as separate parts being joined to form a unit. Deflection members as described herein can be manufactured in a process of additive manufacturing such that they are unitary, as contrasted by processes in which deflection members are manufactured joining together or otherwise modifying separate components. A unitary deflection member may comprise different features and different materials for the different features as described below.

Figure 1:
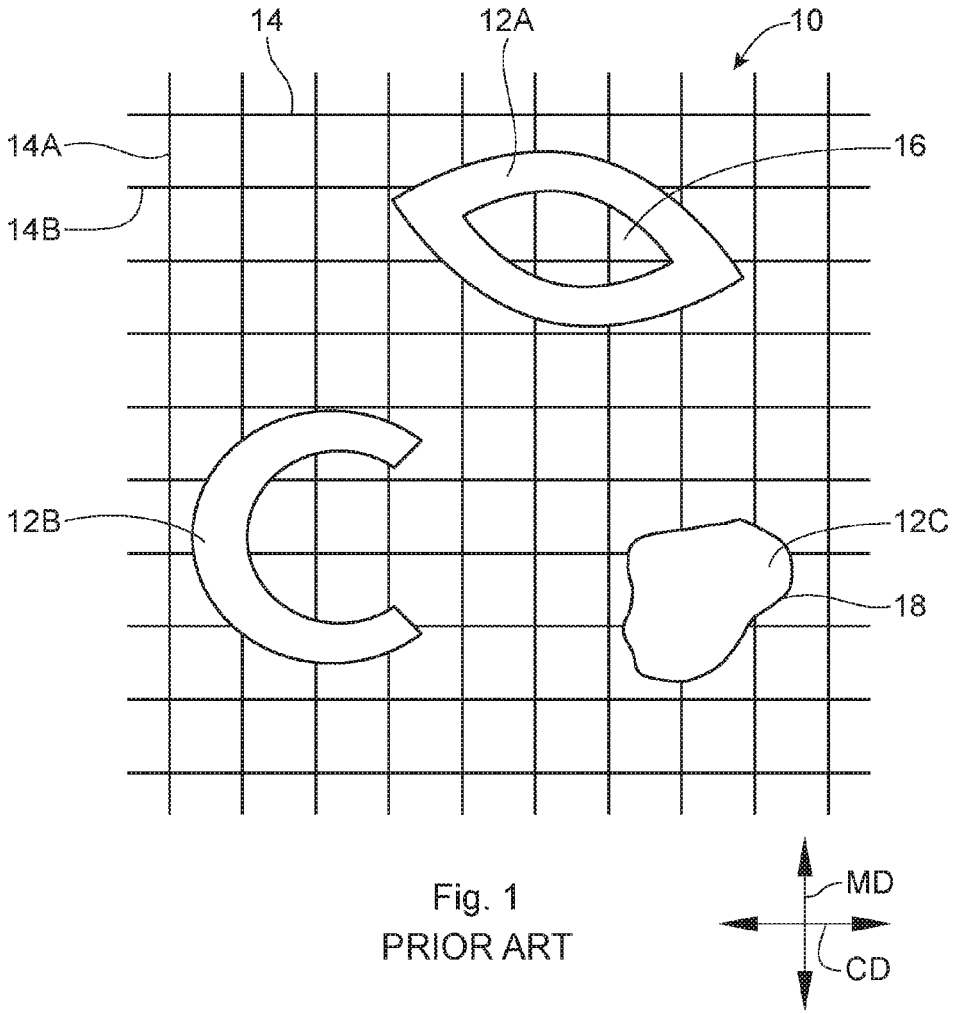
Fig. 1 PRIOR ART
FIG. 1 is a schematic representation of a prior art deflection member.

FIG. 1 shows a deflection member 10 as known in the art which can be generally described as polymer components 12 deposited onto a woven, or grid-like, reinforcing member 14. The polymer components can be UV-cured polymer in shapes including enclosed open shapes 12A, partially enclosed open shapes 12B, and closed shapes 12C. The polymer components are secured onto a woven fabric having filaments 14A oriented in the MD and filaments 14B oriented in the CD.

As can be understood from FIG. 1, traditional reinforcing members force a certain geometry onto the deflection member, a geometry that may not be optimized for certain desirable characteristics, such as air permeability, strength, and paper structure. For example, in enclosed open shape 12A, portions of woven filaments 14 interior to the shape 16, have a forced geometry, with forced physical parameters such as air permeability. However, it may be desirable to have more, fewer, or no filaments 14 interior to an open shape 12A. Likewise, for partially open shapes 12B and closed shapes 12C, the forced geometry of a woven structure forces a number of connection points between the shaped polymer component and the reinforcing member. For example, taking closed shape 12C, the configuration illustrated in FIG. 1 results in 8 filament-to-shaped polymer component connections 18. This number of connections 18 may be more or fewer than the number of connections in certain deflection members where a predetermined optimal value for strength and air permeability, for example, is desired.

Figure 2:
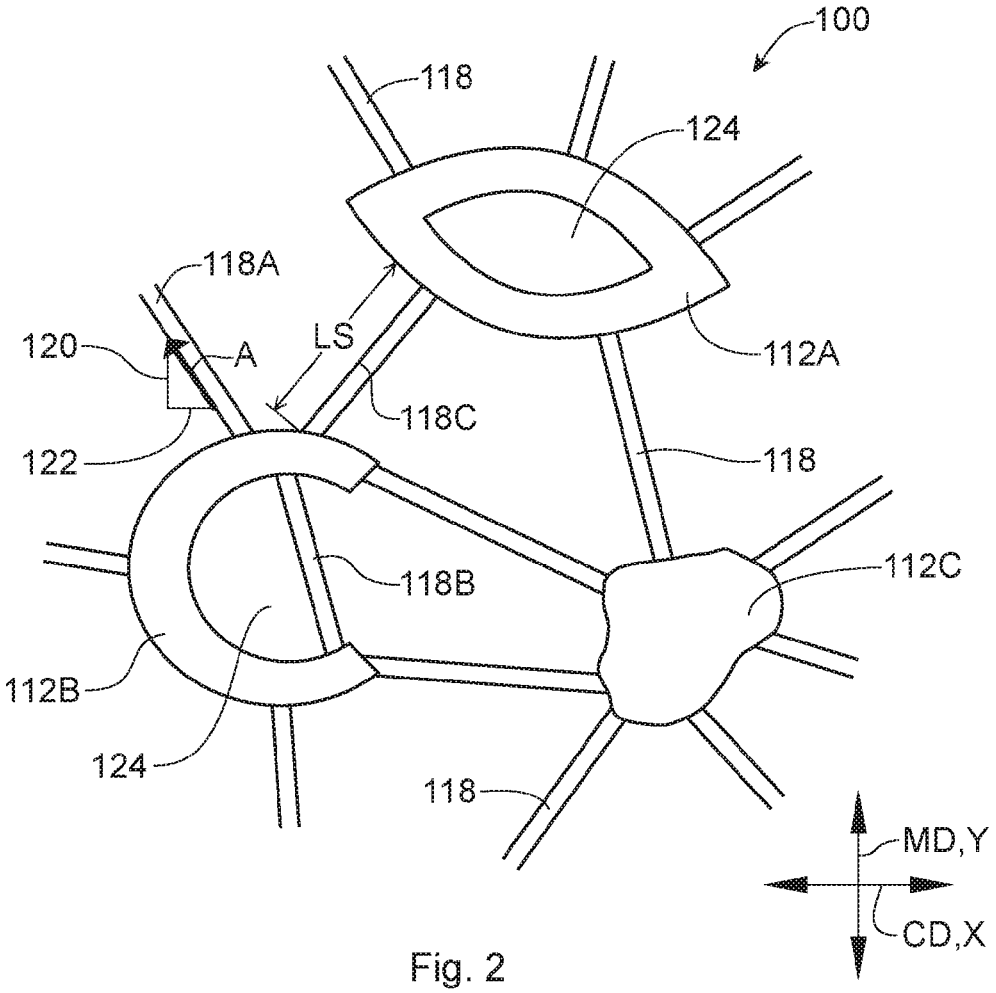
FIG. 2 is a schematic representation of a deflection member of the present invention.

As shown in FIG. 2, a unitary deflection member 100 of the present invention can comprise two identifiable portions: a plurality of discrete primary elements 112 and a plurality of secondary elements 118 that connect adjacent discrete primary elements 112. As shown in FIG. 2, because the geometry of the deflection member is decoupled from the constraints of woven filaments, or other generally orthogonally-situated grid patterns, the number and placement of primary and secondary elements, including the number of actual connections between the various discrete primary elements 112, can be designed in as required for desired finished properties of the deflection member 100. For example, it may be beneficial to have no secondary elements in the interior 124 of an open shape primary element 112A. Likewise, it may be beneficial to have one or more secondary elements 118B connecting portions of a partially open shape primary element 112B. Such additional degrees of freedom of design is not available to papermakers with current technology based on woven fabrics.

For any of the secondary elements 118, as shown in FIG. 2 with secondary element 118A, the secondary element can be described as an elongate member having a major axis A having both a machine direction vector component 120 and a cross machine direction vector component 122. That is, the axis A is at an angle to the machine direction and the cross machine direction. In an example, the angle can be greater than 10 degrees, or greater than 15 degrees, or greater than 20 degrees, or greater than 25 degrees, or greater than 30 degrees, or greater than 35 degrees, or greater than 40 degrees. In an example, the angle can be less than 10 degrees, or less than 15 degrees, or less than 20 degrees, or less than 25 degrees, or less than 30 degrees, or less than 35 degrees, or less than 40 degrees. In an example, the angle can be in any range between the angles listed above. Secondary elements 118 can have any cross-section, including generally circular, triangular, rectangular, or other shape, and the cross-section can be uniform or it can vary along its length.

The illustrated deflection member of FIG. 2 is shown schematically in plan view, with the MD-CD plane corresponding to an X-Y plane. Each element of the deflection member 100 has a thickness in the Z-direction, which in FIG. 2 would be a direction out of the plane of the paper toward the viewer. The actual Z-direction thickness of any particular element can be designed in. In an embodiment, the thickness of each primary element is equal to or greater than the thickness of each secondary element, such that when used to make paper, the primary elements form three-dimensional structure in a manner similar to how "knuckles" are known to do in traditional papermaking. Likewise, secondary elements 118 can have a length LS, defined as the distance from one primary discrete element to another discrete element as indicated on secondary element 18C, or to another secondary element. Secondary elements 118 can also have a width (not designated in FIG. 2) measured in the X-Y plane orthogonal to the axis A, and which can be constant or variable over the length LS of the secondary element. In general, in the disclosed deflection member 100, the height (Z-direction), length, and width of each secondary element, as well as relative spacing of adjacent secondary elements, can be individually and separately determined. That is, because the design of the secondary elements is decoupled from the constraints required with woven filaments or other orthogonal grid patterns, the number, size, and spacing of secondary elements can be designed-in based on desired physical properties, such as the strength and air permeability desired in the deflection member, as well as the design of paper made thereon.

Figure 3:
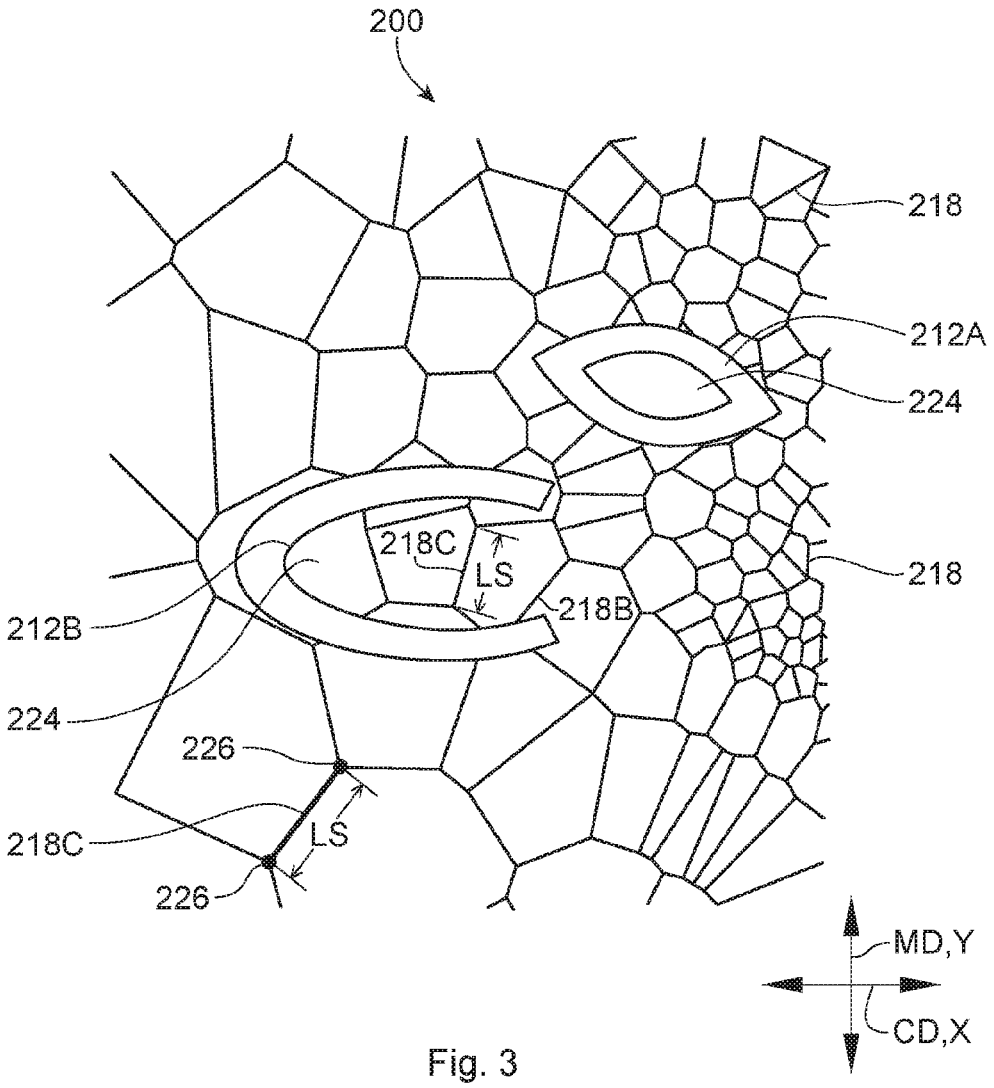
FIG. 3 is a schematic representation of a deflection member of the present invention.
Figure 4:
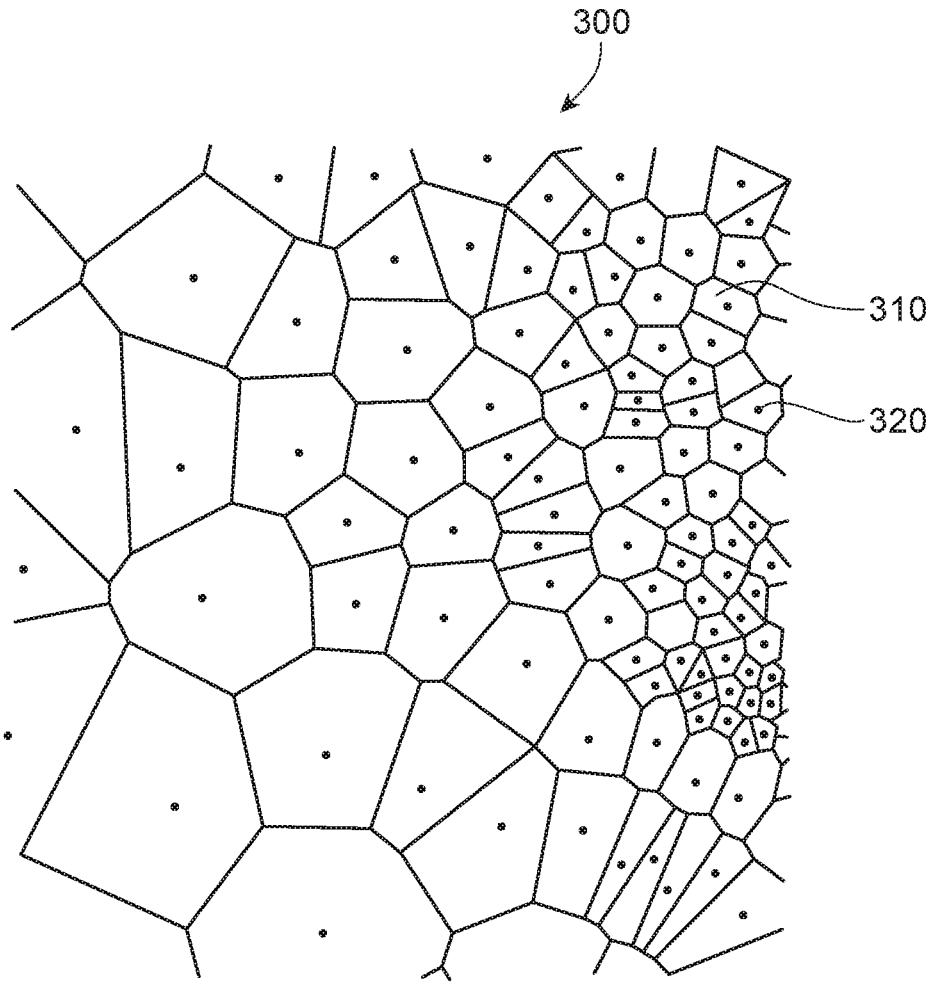
FIG. 4 is a diagram illustrating a Voronoi pattern.

As can be understood from the above description, the number, size, and spacing of secondary elements 118 can be designed in to integrate and optimize a deflection member having a plurality of discrete primary elements 112. The optimization can be achieved by utilizing the principles of a Voronoi pattern. Specifically, as shown in FIG. 3, the plurality of secondary elements can be designed in part, or completely, in accordance with the principles of a Voronoi pattern. As depicted in FIG. 4, a Voronoi pattern 300 is a partitioning of a plane into regions (i.e., "cells" as discussed below) 310 based on distance to points 320 in a specific subset of the plane. That set of points 320 (called seeds, sites, or generators) is specified beforehand, and for each seed there is a corresponding region consisting of all points closer to that seed than to any other. These regions are called Voronoi cells 310. The Voronoi diagram of a set of points is dual to its Delaunay triangulation. A Voronoi pattern can be created by taking pairs of points that are close together and drawing a line that is equidistant between them and perpendicular to the line connecting them. That is, all points on the lines in the diagram are equidistant to the nearest two (or more) source points.

Referring again to FIG. 3, for a deflection member 200, discrete primary elements 212 can be overlaid or otherwise integrated into a pattern that is at least partially a Voronoi pattern. That is, the secondary elements 218 have a length and orientation (in the MD-CD plane) in accordance with the principles of a Voronoi diagram, based on predetermined points 320 (not shown in FIG. 3), such that the secondary elements 218 each correspond to an edge of a Voronoi cell 310. It may be that certain portions of deflection member 200, such as portion 224 interior of a closed open shape 212A is free of any secondary elements.

The number of points 320, and, in turn, the number of cells 310, which in turn can determine the number of secondary elements, can be predetermined and designed into the structure based on desired parameters such as strength and air permeability of the resulting deflection member. For example, a value for air permeability, as well as an arrangement that facilitates uniform air permeability, can be designed based on the number and spacing of desired primary elements and secondary elements. Better uniformity of air permeability across the area of a deflection member facilitates improved drying efficiency when the deflection member is utilized for papermaking. Likewise, the number, size, spacing and orientation of secondary elements can be designed for optimal fiber support during papermaking. By way of example, the number, size, spacing and orientation of secondary elements can be designed to minimize or eliminate pin holing, which can happen when the juxtaposition of polymer elements on a woven reinforcing member results in a randomly situated large opening, through which fibers can pass during papermaking.

Figure 5:
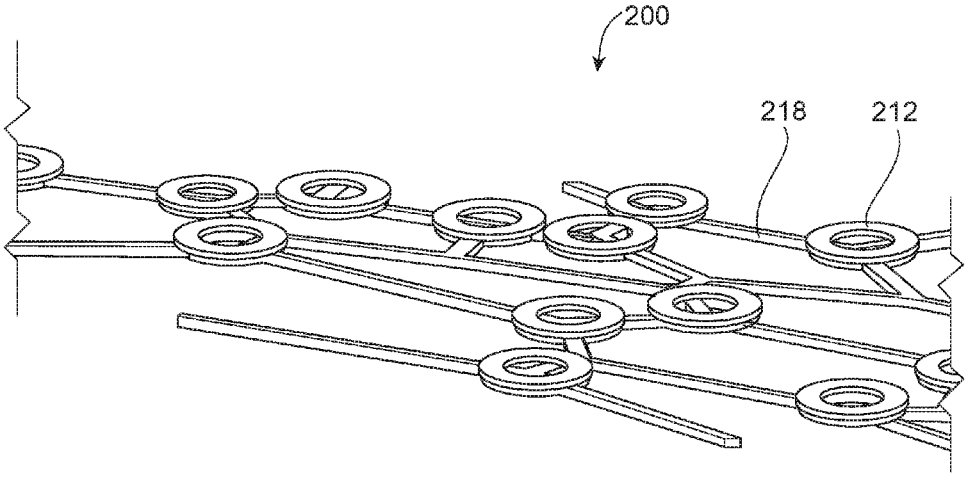
FIG. 5 is a computer generated image showing a perspective view of the structure of an embodiment of a unitary deflection member of the present invention.

FIG. 5 shows a digitally produced image of a non-limiting example of a unitary deflection member in which a plurality of discrete primary elements 212 are joined in a unitary manner onto a plurality of secondary elements 218, with the secondary elements 218 arranged according to a Voronoi pattern. In this exemplary pattern, the discrete primary elements 212 are identical in size and shape and are generally described as generally flat "donut" shaped. Likewise, the secondary elements are depicted as generally the same cross-sectional dimension, but in differing lengths. In general, each discrete primary element can have its individual size and shape, and each secondary element can have its individual size and shape. Thus, the pattern depicted in FIG. 5 is illustrative, and not to be limiting. A unitary deflection member can be built according to the additive manufacturing methods disclosed herein to product a unitary structure of discrete primary elements connected to a plurality of secondary elements.

Figure 6:
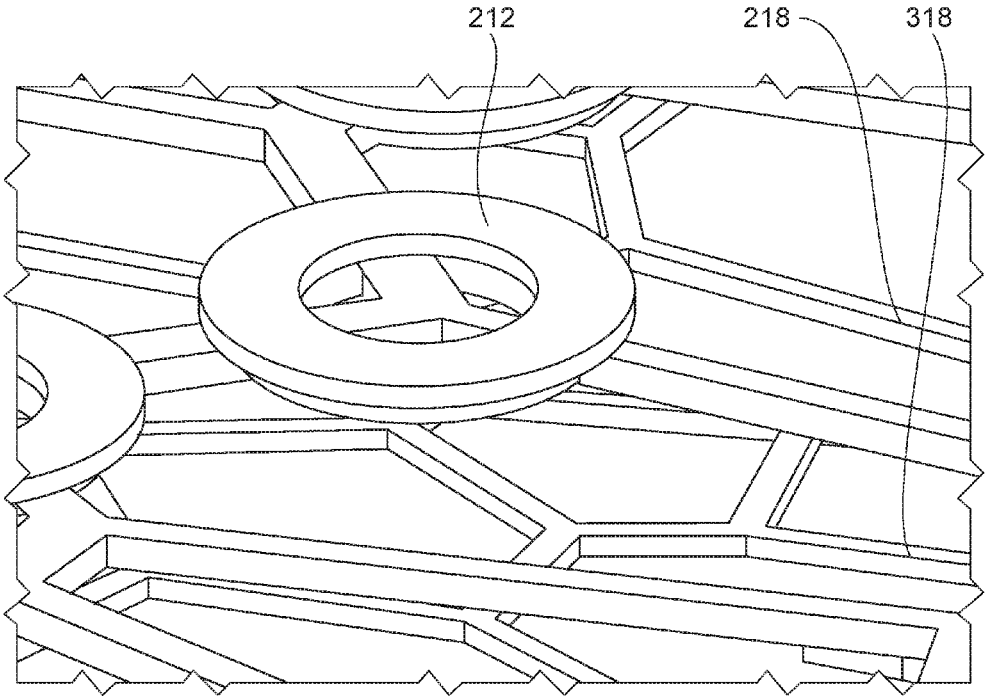
FIG. 6 is a computer generated image showing a perspective view of the structure of an embodiment of a unitary deflection member of the present invention.

FIG. 6 shows a digitally produced image of a non-limiting embodiment of a unitary deflection member in which a plurality of discrete primary elements 212 are overlayed in a unitary manner onto a plurality of secondary elements 218, with the secondary elements 218 arranged according to a Voronoi pattern generally in a plane, and the plane of the secondary elements is "stacked," so to speak, on an additional plurality of secondary elements 318 which are also arranged according to a Voronoi pattern generally in a plane. The description of the discrete primary elements 212 is generally identical to the description in FIG. 5. Likewise, the secondary elements 218 can be as described with respect to FIG. 5. Each of the secondary elements 318 can as well have its individual size and shape. As with FIG. 5, the pattern depicted in FIG. 6 is merely illustrative, and not to be limiting. Such a deflection member can be built according to the additive manufacturing methods disclosed herein to product a unitary structure of discrete primary elements connected to a plurality of secondary elements.

The unitary deflection members shown in FIGS. 5 and 6 are digitally produced images of non-limiting embodiments of unitary deflection members. The digital images are utilized in the method of making a unitary deflection member 200, as described in more detail below. Because of the precision associated with additive manufacturing technology, the unitary deflection member 200 has a substantially identical structure as that depicted in the digital images, thus the digital images will be used to describe the various features of the unitary defection member 10.

The arrangement of secondary elements can have an open area sufficient to allow water to pass through during drying stages of a papermaking process, but nevertheless prevent fibers from being drawn through in dewatering processes, including pressing and vacuum processes. As fibers are molded into the deflection member during production of fibrous substrates such as absorbent tissue paper, the secondary elements can serve as a "backstop" to prevent, or minimize fiber loss through the unitary deflection member.

Utilizing the numbering of FIGS. 2 and 5, the plurality of secondary elements 118, 218 provides for fluid permeable structural stability of the deflection member 100, 200. The unitary deflection member 100, 200 may be made from a variety of materials or combination of materials, limited only by the additive manufacturing technology used to form it and the desired structural properties such as strength and flexibility. In an embodiment the unitary deflection member 100, 200 can be made from metal, metal-impregnated resin, plastic, or any combination thereof. In an embodiment, the unitary deflection member is sufficiently strong and/or flexible to be utilized as a papermaking belt, or a portion thereon, in a batch process or in commercial papermaking equipment.

Figure 7:
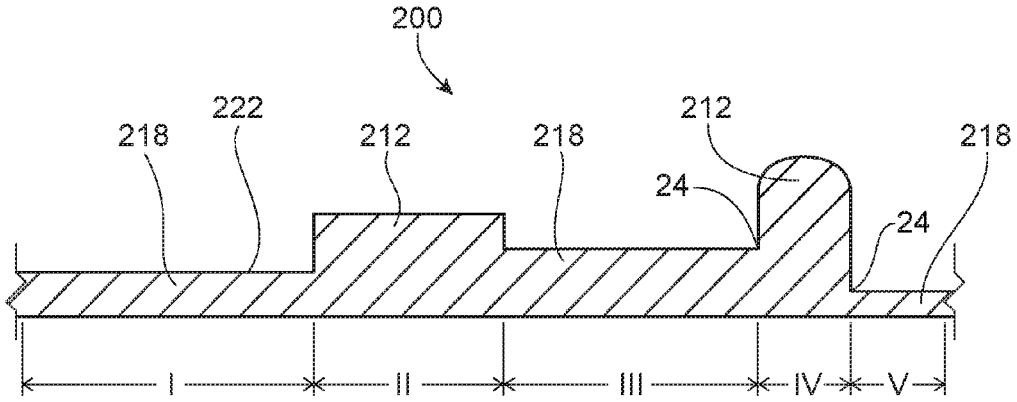
FIG. 7 is a cross-sectional representation of a unitary deflection member shown.

FIG. 7 schematically depicts a cross-sectional representation of a representative deflection member 200 of the present disclosure. The unitary deflection member 200 has a backside 220 and a web side 222. In a fibrous web making process, the web side can be the side of the deflection member on which fibers, such as papermaking fibers, are deposited. As defined herein, the backside 220 of the deflection member 200, forms an X-Y plane, where X and Y can correspond generally to the CD and MD, respectively, when in the context of using the deflection member 200 to make paper in a commercial papermaking process. One skilled in the art will appreciate that the symbols "X," "Y," and "Z" designate a system of Cartesian coordinates, wherein mutually perpendicular "X" and "Y" define a reference plane formed by the backside 20 of the unitary deflection member 200 when disposed on a flat surface, and "Z" defines a direction orthogonal to the X-Y plane. The person skilled in the art will appreciate that the use of the term "plane" does not require absolute flatness or smoothness of any portion or feature described as planar. In fact, the backside 220 of the deflection member 200 can have texture, including so-called "backside texture" which is helpful when the deflection member is used as a papermaking belt on vacuum rolls in a papermaking process.

As used herein, the term "Z-direction" designates any direction perpendicular to the X-Y plane. Analogously, the term "Z-dimension" means a dimension, distance, or parameter measured parallel to the Z-direction and can be used to refer to dimensions such as the height of discrete primary elements or the thickness (or height or caliper), of the secondary elements. It should be carefully noted, however, that an element that "extends" in the Z-direction does not need itself to be oriented strictly parallel to the Z-direction; the term "extends in the Z-direction" in this context merely indicates that the element extends in a direction which is not parallel to the X-Y plane. Analogously, an element that "extends in a direction parallel to the X-Y plane" does not need, as a whole, to be parallel to the X-Y plane; such an element can be oriented in the direction that is not parallel to the Z-direction.

One skilled in the art will also appreciate that the unitary deflection member 200 as a whole does not need to (and indeed cannot in some embodiments) have a planar configuration throughout its length, especially if sized for use in a commercial process for making a fibrous structure 850 of the present invention, and in the form of an flexible member or belt that travels through the equipment in a machine direction (MD) indicated by a directional arrow "B" (FIG. 15). The concept of the unitary deflection member 200 being disposed on a flat surface and having the macroscopical "X-Y" plane is conventionally used herein for the purpose of describing relative geometry of several elements of the unitary deflection member 200 which can be generally flexible. A person skilled in the art will appreciate that when the unitary deflection member 200 curves or otherwise deplanes, the X-Y plane follows the configuration of the unitary deflection member 200.

As used herein, the terms containing "macroscopical" or "macroscopically" refer to an overall geometry of a structure under consideration when it is placed in a two-dimensional configuration. In contrast, "microscopical" or "microscopically" refer to relatively small details of the structure under consideration, without regard to its overall geometry. For example, in the context of the unitary deflection member 200, the term "macroscopically planar" means that the unitary deflection member 200, when it is placed in a two-dimensional configuration, has—as a whole—only minor deviations from absolute planarity, and the deviations do not adversely affect the unitary deflection member's performance. At the same time, the patterned framework 12 of the unitary deflection member 200 can have a microscopical three-dimensional pattern of deflection conduits and suspended portions, as will be described below.

As shown in FIG. 7, the deflection member 200 comprises a plurality of discrete primary elements 212. Each discrete primary element 212 extends in the Z-direction on the web-side 222 of the deflection member. Each of the plurality of discrete primary elements 212 can be unitary with the plurality of secondary elements 218 and extends therefrom in the Z-direction at a transition portion 224 which can be a smooth, radiused transition. The deflection member, including the discrete primary elements and secondary elements can be of one material, with an uninterrupted material transition between any two parts. Portions of the deflection member, including the discrete primary elements and secondary elements can differ in material content, but in the unitary deflection members described herein the material transition is due to different materials used in an additive manufacturing process, and not to discrete materials adhered, cured, or otherwise joined.

As depicted in FIG. 7, various advantageous properties of a deflection member can be realized by utilizing predetermined, designed-in dimensions of the various components. In FIG. 7, some of the various properties are identified with respect to Sections I-V. For example, discrete primary elements 212 can be individually sized, shaped, and spaced. Two discrete primary elements 212 are depicted in FIG. 7, one in Section II with a generally flat distal portion (portion distal from first side 220) and one in Section IV with a generally rounded, convex distal portion. As shown, the discrete primary element 212 in Section IV has a greater caliper, i.e., dimension in the Z-direction measured from first side 220, than does the discrete primary element 212 shown in Section II. Of course, any size and shape can be achieved, based on the desired end results of the deflection member and the paper made thereon. Likewise, the dimensions of secondary elements can be predetermined and designed-in based on the end result properties of the deflection member or paper made thereon. As shown in FIG. 7, referring to Sections I, III, and V, the secondary elements 218 can vary in relation to one another in length and caliper, i.e., dimension in the Z-direction measured from first side 220. Although not shown, the secondary elements 218 can also vary in relation to one another in width. Height and width of secondary elements need not be uniform along the entire length, but can vary according to the desired end result properties of the deflection member and paper made thereon.

There are virtually an infinite number of shapes, sizes, spacing and orientations that may be chosen for discrete primary elements 212 and secondary elements 218. The actual shapes, sizes, orientations, and spacing can be specified and manufactured by additive manufacturing processes based on a desired design of the end product, such as a fibrous structure having a regular pattern of substantially identical "knuckles" regions separated by "pillow" regions, as discussed in more detail below. The improvement of the present invention is that the shapes, sizes, spacing, and orientations of the discrete primary elements 212, and shapes, sizes, spacing, and orientations of the secondary elements 218 is decoupled from the imposed limitations of woven or grid-like structures of strictly MD- and CD-oriented elements. In general, the discrete primary elements can take any of the forms disclosed in the aforementioned commonly owned U.S. Provisional Application 62/155,517.

Process for Making Unitary Deflection Member

A unitary deflection member can be made by a 3-D printer as the additive manufacturing making apparatus. Unitary deflection members of the invention were made using a MakerBot Replicator 2, available from MakerBot Industries, Brooklyn, N.Y., USA. Other alternative methods of additive manufacturing include, by way of example, selective laser sintering (SLS), stereolithography (SLA), direct metal laser sintering, or fused deposition modeling (FDM, as marketed by Stratasys Corp., Eden Prairie, Minn.), also known as fused filament fabrication (FFF).

The material used for the unitary deflection member of the invention is poly lactic acid (PLA) provided in a 1.75 mm diameter filament in various colors, for example, TruWhite and TruRed. Other alternative materials can include liquid photopolymer, high melting point filament (50 degrees C. to 120 degrees C. above Yankee temperature), flexible filament (e.g., NinjaFlex PLA, available from Fenner Drives, Inc, Manheim, Pa., USA), clear filament, wood composite filament, metal/composite filament, Nylon powder, metal powder, quick set epoxy. In general, any material suitable for 3-D printing can be used, with material choice being determined by desired properties related to strength and flexibility, which, in turn, can be dictated by operating conditions in a papermaking process, for example. In the present invention, the method for making fibrous substrates can be achieved with relatively stiff deflection members.

A 2-D image of a repeat element of a desired unitary deflection member, created in, for example, AutoCad, DraftSight, or Illustrator, can be exported to a 3-D file such as a drawing file in SolidWorks 3-D CAD or other NX software. The repeat unit has the dimensional parameters for wall angles, protrusion shape, and other features of the deflection member. Optionally, one can create a file directly in the a 3-D modeling program, such as Google SketchUp or other solid modeling programs that can, for example, create standard tessellation language (STL) file. The STL file for a repeat element and repeat element dimensions for the present invention was exported to, and imported by, the MakerWare software utilized by the MakerBot printer. Optionally, Slicr3D software can be utilized for this step.

The next step is to assemble objects for the various features of a deflection member, such as the secondary elements, transition portions, and protuberances, assign Z-direction dimensions for each. Once all the objects are assembled, they are imported and used to make an x3g print file. An x3g file is a binary file that the MakerWare machine reads which contains all of the instructions for printing. The output x3g file can be saved on an SD card, or, optionally connect via a USB cable directly to the computer. The SD card with the x3g file can be inserted into the slot provided on the MakerBot 3-D printer. In general, any numerical control file, such as G-code files, as is known in the art, can be used to import a print file to the additive manufacturing device.

Prior to printing, the build platform of the MakerBot 3-D printer can be prepared. If the build plate is unheated, it can be prepared by covering it with 3M brand Scotch-Blue Painter's Tape #2090, available from 3M, Minneapolis, Minn., USA. For a heated build plate, the plate is prepared by using Kapton tape, manufactured by DuPont, Wilmington, Del., USA, and water soluble glue stick adhesive, hair spray, with a barrier film. The build platform should be clean and free from oil, dust, lint, or other particles.

The printing nozzle of the MakerBot 3-D printer used to make the invention was heated to 230 degrees C.

The printing process is started to print the deflection member, after which the equipment and deflection member are allowed to cool. Once sufficiently cooled, the deflection member can be removed from the build plate by use of a flat spatula, a putty knife, or any other suitable tool or device. The deflection member can then be utilized to a process for making a fibrous structure, as described below.

The unitary deflection member 200 can have a specific resulting open area R. As used herein, the term "specific resulting open area" (R) means a ratio of a cumulative projected open area (ΣR) of all deflection conduits of a given unit of the unitary deflection member's surface area (A) to that given surface area (A) of this unit, i.e., $R=\Sigma R/A$, wherein the projected open area of each individual conduit is formed by a smallest projected open area of such a conduit as measured in a plane parallel to the X-Y plane. The specific open area can be expressed as a fraction or as a percentage. For example, if a hypothetical layer has two thousand individual deflection conduits dispersed throughout a unit surface area (A) of thirty thousand square millimeters, and each deflection conduit has the projected open area of five square millimeters, the cumulative projected open area (ΣR) of all two thousand deflection conduits is ten thousand square millimeters, (5 sq. mm×2.000=10,000 sq. mm), and the specific resulting open area of such a hypothetical layer is R=¼, or 33.33% (ten thousand square millimeters divided by thirty thousand square millimeters).

The cumulative projected open area of each individual conduit is measured based on its smallest projected open area parallel to the X-Y plane, because some deflection conduits may be non-uniform throughout their length, or thickness of the deflection member. For example, some deflection conduits may be tapered as described in commonly assigned U.S. Pat. Nos. 5,900,122 and 5,948,210. In other embodiments, the smallest open area of the individual conduit may be located intermediate the top surface and the bottom surface of the unitary deflection member.

The specific resulting open area of the unitary deflection member can be at least ⅕ (or 20%), more specifically, at least ⅖ (or 40%), and still more specifically, at least ⅗ (or 60%). According to the present invention, the first specific resulting open area R1 may be greater than, substantially equal to, or less than the second resulting open area R2.

Fibrous Structure

One purpose of the deflection member disclosed herein is to provide a forming surface on which to mold fibrous structures, including sanitary tissue products, such as paper towels, toilet tissue, facial tissue, wipes, dry or wet mop covers, and the like. When used in a papermaking process, the deflection member can be utilized in the "wet end" of a papermaking process, as described in more detail below, in which fibers from a fibrous slurry are deposited on the web side of the deflection member. As discussed below, a portion of the fibers can be deflected into the deflection conduits of the unitary deflection member to cause some of the deflected fibers or portions thereof to be disposed within the void spaces, i.e., the deflection conduits, formed by, i.e., between, the discrete primary elements of the unitary deflection member.

Thus, as can be understood from the description above, a fibrous structure an mold to the general shape of the deflection member, including the deflection conduits such that the shape and size of the knuckles and pillow features of the fibrous structure are a close approximation of the size and shape of the discrete primary elements and deflection conduits. Fibers can be pressed or otherwise introduced over the protuberances and into the deflection conduits at a constant basis weight to form relatively low density pillows in the finished fibrous structure Process for Making Fibrous Structure With reference to FIG. 8, one exemplary embodiment of the process for producing the fibrous structure 850 of the present invention comprises the following steps. First, a plurality of fibers 850 is provided and is deposited on a forming wire of a papermaking machine, as is known in the art.

The present invention contemplates the use of a variety of fibers, such as, for example, cellulosic fibers, synthetic fibers, or any other suitable fibers, and any combination thereof. Papermaking fibers useful in the present invention include cellulosic fibers commonly known as wood pulp fibers. Fibers derived from soft woods (gymnosperms or coniferous trees) and hard woods (angiosperms or deciduous trees) are contemplated for use in this invention. The particular species of tree from which the fibers are derived is immaterial. The hardwood and softwood fibers can be blended, or alternatively, can be deposited in layers to provide a stratified web. U.S. Pat. No. 4,300,981 issued Nov. 17, 1981 to Carstens and U.S. Pat. No. 3,994,771 issued Nov. 30, 1976 to Morgan et al. are incorporated herein by reference for the purpose of disclosing layering of hardwood and softwood fibers.

The wood pulp fibers can be produced from the native wood by any convenient pulping process. Chemical processes such as sulfite, sulfate (including the Kraft) and soda processes are suitable. Mechanical processes such as thermomechanical (or Asplund) processes are also suitable. In addition, the various semi-chemical and chemi-mechanical processes can be used. Bleached as well as unbleached fibers are contemplated for use. When the fibrous web of this invention is intended for use in absorbent products such as paper towels, bleached northern softwood Kraft pulp fibers may be used. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

In addition to the various wood pulp fibers, other cellulosic fibers such as cotton linters, rayon, and bagasse can be used in this invention. Synthetic fibers, such as polymeric fibers, can also be used. Elastomeric polymers, polypropylene, polyethylene, polyester, polyolefin, and nylon, can be used. The polymeric fibers can be produced by spunbond processes, meltblown processes, and other suitable methods known in the art. It is believed that thin, long, and continuous fibers produces by spunbond and meltblown processes may be beneficially used in the fibrous structure of the present invention, because such fibers are believed to be easily deflectable into the pockets of the unitary deflection member of the present invention.

The paper furnish can comprise a variety of additives, including but not limited to fiber binder materials, such as wet strength binder materials, dry strength binder materials, and chemical softening compositions. Suitable wet strength binders include, but are not limited to, materials such as polyamide-epichlorohydrin resins sold under the trade name of KYMENE™ 557H by Hercules Inc., Wilmington, Del. Suitable temporary wet strength binders include but are not limited to synthetic polyacrylates. A suitable temporary wet strength binder is PAREZ™ 750 marketed by American Cyanamid of Stanford, Conn. Suitable dry strength binders include materials such as carboxymethyl cellulose and cationic polymers such as ACCO™ 711. The CYPRO/ACCO family of dry strength materials are available from CYTEC of Kalamazoo, Mich.

The paper furnish can comprise a debonding agent to inhibit formation of some fiber to fiber bonds as the web is dried. The debonding agent, in combination with the energy provided to the web by the dry creping process, results in a portion of the web being debulked. In one embodiment, the debonding agent can be applied to fibers forming an intermediate fiber layer positioned between two or more layers. The intermediate layer acts as a debonding layer between outer layers of fibers. The creping energy can therefore debulk a portion of the web along the debonding layer. Suitable debonding agents include chemical softening compositions such as those disclosed in U.S. Pat. No. 5,279,767 issued Jan. 18, 1994 to Phan et al., the disclosure of which is incorporated herein by reference Suitable biodegradable chemical softening compositions are disclosed in U.S. Pat. No. 5,312,522 issued May 17, 1994 to Phan et al. U.S. Pat. Nos. 5,279,767 and 5,312,522, the disclosures of which are incorporated herein by reference. Such chemical softening compositions can be used as debonding agents for inhibiting fiber to fiber bonding in one or more layers of the fibers making up the web. One suitable softener for providing debonding of fibers in one or more layers of fibers forming the web 20 is a papermaking additive comprising DiEster Di (Touch Hardened) Tallow Dimethyl Ammonium Chloride. A suitable softener is ADOGEN® brand papermaking additive available from Witco Company of Greenwich, Conn.

The embryonic web can be typically prepared from an aqueous dispersion of papermaking fibers, though dispersions in liquids other than water can be used. The fibers are dispersed in the carrier liquid to have a consistency of from about 0.1 to about 0.3 percent. Alternatively, and without being limited by theory, it is believed that the present invention is applicable to moist forming operations where the fibers are dispersed in a carrier liquid to have a consistency less than about 50 percent. In yet another alternative embodiment, and without being limited by theory, it is believed that the present invention is also applicable to airlaid structures, including air-laid webs comprising pulp fibers, synthetic fibers, and mixtures thereof.

Conventional papermaking fibers can be used and the aqueous dispersion can be formed in conventional ways. Conventional papermaking equipment and processes can be used to form the embryonic web on the Fourdrinier wire. The association of the embryonic web with the unitary deflection member can be accomplished by simple transfer of the web between two moving endless belts as assisted by differential fluid pressure. The fibers may be deflected into the unitary deflection member 200 by the application of differential fluid pressure induced by an applied vacuum. Any technique, such as the use of a Yankee drum dryer, can be used to dry the intermediate web. Foreshortening can be accomplished by any conventional technique such as creping.

The plurality of fibers can also be supplied in the form of a moistened fibrous web (not shown), which should preferably be in a condition in which portions of the web could be effectively deflected into the deflection conduits of the unitary deflection member and the void spaces formed between the suspended portions and the X-Y plane.

Figure 8:
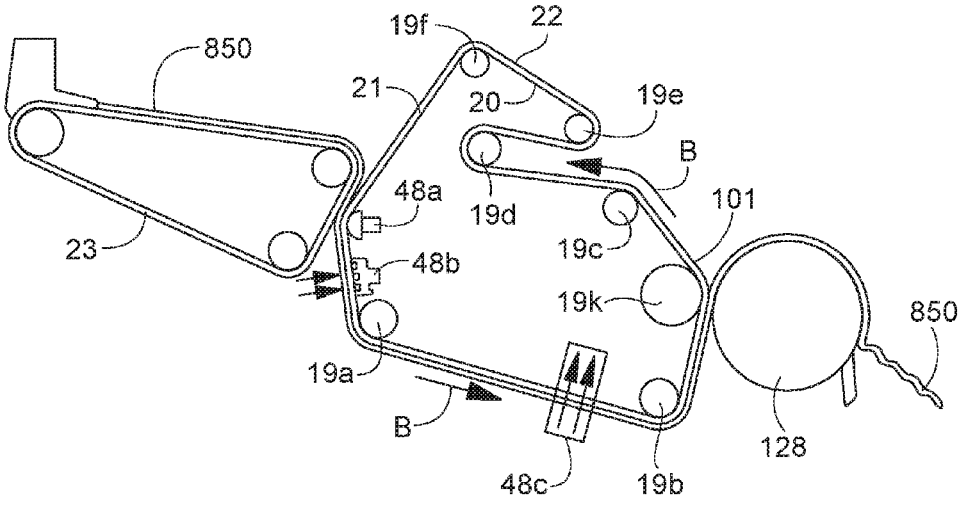
FIG. 8 is an elevation schematic representation of a papermaking process.

In FIG. 8, the embryonic web comprising fibers 850 is transferred from a forming wire 23 to a belt 21 on which a unitary deflection member having an area dimension of approximately 0.5-12 square inches can be disposed by placing it on the belt 21 upstream of a vacuum pick-up shoe 48*a*. Alternatively or additionally, a plurality of fibers, or fibrous slurry, can be deposited onto the unitary deflection member 200 directly (not shown) from a headbox or otherwise, including in a batch process. The papermaking belt comprising unitary deflection member held between the embryonic web and the belt 21 can travel past optional dryers/vacuum devices 48*b* and about rolls 19*a*, 19*b*, 19*k*, 19*c*, 19*d*, 19*e*, and 19*f* in the direction schematically indicated by the directional arrow "B."

A portion of the fibers 850 is deflected into the deflection portion of the unitary deflection member such as to cause some of the deflected fibers or portions thereof to be disposed within the void spaces formed by the discrete primary elements of the unitary deflection member. Depending on the process, mechanical and fluid pressure differential, alone or in combination, can be utilized to deflect a portion of the fibers 850 into the deflection conduits of the unitary deflection member. For example, in a through-air drying process a vacuum apparatus 48*c* can apply a fluid pressure differential to the embryonic web disposed on the unitary deflection member, thereby deflecting fibers into the deflection conduits of the unitary deflection member. The process of deflection may be continued with additional vacuum pressure, if necessary, to even further deflect the fibers into the deflection conduits of the unitary deflection member.

Finally, a partly-formed fibrous structure associated with the unitary deflection member can be separated from the unitary deflection member at roll 19*k* at the transfer to a Yankee dryer 128. By doing so, the unitary deflection member having the fibers thereon is pressed against a pressing surface, such as, for example, a surface of a Yankee drying drum 128, thereby densifying generally high density knuckles. In some instances, those fibers that are disposed within the deflection conduits can also be at least partially densified.

After being creped off the Yankee dryer, a fibrous structure 850 of the present invention can result and can be further processed or converted as desired.

What is claimed is:

1. A deflection member, the deflection member comprising in a unitary structure having a machine direction and a cross machine direction orthogonal to the machine direction:

a. a plurality of discrete primary elements, each primary element being separated from a nearest of the discrete primary elements by a distance;

b. a plurality of secondary elements, at least one of the secondary elements being unitary with at least one of the discrete primary elements, and being an elongate member having a major axis having both a machine direction vector component and a cross machine direction vector component; and c. the plurality of secondary elements being interconnected to define a set spacing between each of the plurality of discrete primary elements.

2. The deflection member of claim 1, wherein the deflection member has a thickness measured in a Z-direction orthogonal to the plane of the machine direction and cross machine direction, and wherein the primary elements extend a greater distance in the Z-direction than the secondary elements.

3. The deflection member of claim 1, wherein the primary elements and secondary elements define a surface open area.

4. The deflection member of claim 1, wherein the secondary elements are connected to adjacent secondary elements at nodes.

5. The deflection member of claim 1, wherein each node comprises a joining of three secondary elements.

6. The deflection member of claim 1, wherein the primary elements and the secondary elements comprise polymeric material.

7. The deflection member of claim 1, wherein the primary elements and the secondary elements comprise the same polymeric material.

8. The deflection member of claim 1, wherein secondary elements form a substantially Voronoi pattern.

9. The deflection member of claim 1, wherein the deflection member is in the form of a continuous belt.

10. A deflection member, the deflection member comprising in a unitary structure having a machine direction and a cross machine direction orthogonal to the machine direction:

a. a plurality of discrete primary elements, each primary element being separated from a nearest of the discrete primary elements by a distance;

b. a plurality of secondary elements, at least one of the secondary elements being unitary with at least one of the discrete primary elements, and being an elongate member having a major axis having both a machine direction vector component and a cross machine direction vector component; and c. the plurality of secondary elements being interconnected in a substantially Voronoi pattern to define a set spacing between each of the plurality of discrete primary elements.

11. The deflection member of claim 10, wherein the deflection member has a thickness measured in a Z-direction orthogonal to the plane of the machine direction and cross machine direction, and wherein the primary elements extend a greater distance in the Z-direction than the secondary elements.

12. The deflection member of claim 10, wherein the primary elements and secondary elements define a surface open area.

13. The deflection member of claim 10, wherein the secondary elements are connected to adjacent secondary elements at nodes.

14. The deflection member of claim 10, wherein each node comprises a joining of three secondary elements.

15. The deflection member of claim 10, wherein the primary elements and the secondary elements comprise polymeric material.

16. A deflection member, the deflection member comprising in a unitary structure having a machine direction and a cross machine direction orthogonal to the machine direction:

a. a plurality of discrete primary elements joined to a plurality of secondary elements, at least one of the secondary elements being unitary with at least one of the discrete primary elements, and b. wherein the plurality of secondary elements are interconnected in a substantially Voronoi pattern to define a set spacing between each of the plurality of discrete primary elements.

17. The deflection member of claim 16, wherein the deflection member has a thickness measured in a Z-direction orthogonal to the plane of the machine direction and cross machine direction, and wherein the primary elements extend a greater distance in the Z-direction than the secondary elements.

18. The deflection member of claim 17, wherein the primary elements and secondary elements define a surface open area.

19. The deflection member of claim 17, wherein the secondary elements are connected to adjacent secondary elements at nodes.

20. The deflection member of claim 17, wherein the primary elements and the secondary elements comprise polymeric material.

* * * * *